US009161590B2

(12) United States Patent
Mazzarolo

(10) Patent No.: US 9,161,590 B2
(45) Date of Patent: Oct. 20, 2015

(54) MOTORCYCLE BOOT WITH VENTILATED STRUCTURE

(75) Inventor: Giovanni Mazzarolo, Coste di Maser (IT)

(73) Assignee: ALPINESTARS RESEARCH SRL, Coste di Maser (Treviso) (IT)

( * ) Notice: Subject to any disclaimer, the term of this patent is extended or adjusted under 35 U.S.C. 154(b) by 555 days.

(21) Appl. No.: 13/058,406

(22) PCT Filed: Aug. 13, 2009

(86) PCT No.: PCT/IB2009/053576
§ 371 (c)(1),
(2), (4) Date: May 2, 2011

(87) PCT Pub. No.: WO2010/018554
PCT Pub. Date: Feb. 18, 2010

(65) Prior Publication Data

US 2011/0197477 A1 Aug. 18, 2011

(30) Foreign Application Priority Data

Aug. 13, 2008 (IT) ..... TV2008A0108

(51) Int. Cl.
*A43B 7/06* (2006.01)
*A43B 13/38* (2006.01)
*A43B 5/14* (2006.01)

(52) U.S. Cl.
CPC .. *A43B 5/145* (2013.01); *A43B 7/06* (2013.01)

(58) Field of Classification Search
CPC .... A43B 7/06082; A43B 7/084; A43B 5/145; A43B 7/06
USPC ..... 36/3 R, 3 A, 3 B
See application file for complete search history.

(56) References Cited

U.S. PATENT DOCUMENTS 1,696,457 A 12/1928 Shanahan
1,932,557 A 10/1933 Meucci
(Continued)

FOREIGN PATENT DOCUMENTS

DE 29600910 U1 3/1996
EP 1857000 A1 11/2007
(Continued)

OTHER PUBLICATIONS

"PCT International Search Report dated Nov. 26, 2009 for PCT/IB2009/053576, from which the instant application is based," 3 pgs.
(Continued)

*Primary Examiner* — Khoa Huynh
*Assistant Examiner* — Timothy K Trieu
(74) *Attorney, Agent, or Firm* — Fredrikson & Byron, P.A.

(57) ABSTRACT

A footwear article, in particular a motorcycle boot comprises an air intake which is formed in an offset position in the zone where an upper and an outsole or tread are joined together, the air intake, which is protected by a protection mesh, is aligned with an interspace formed between the inner surface of the outsole and a midsole which closes the bottom of the upper and which has at least one through-holes, preferably a plurality of holes, an insole is situated above the midsole and comprises a layer of air-permeable material which has a plurality of ducts or channels for distributing air along the entire bottom surface of the user's foot and comprises an optional upper layer of breathable material.

19 Claims, 5 Drawing Sheets

(56) References Cited

U.S. PATENT DOCUMENTS

| | | | | |
|---|---|---|---|---|
| 3,048,931 | A * | 8/1962 | Farinello | 36/3 R |
| 3,273,264 | A | 9/1966 | Farinello | |
| 4,100,685 | A | 7/1978 | Dassler | |
| 4,587,749 | A | 5/1986 | Berlese | |
| 4,693,021 | A | 9/1987 | Mazzarolo | |
| 5,171,033 | A | 12/1992 | Olson | |
| D339,672 | S | 9/1993 | Olson | |
| 5,331,752 | A | 7/1994 | Johnson | |
| 5,342,070 | A | 8/1994 | Miller | |
| 5,369,895 | A * | 12/1994 | Hammerschmidt | 36/3 A |
| 5,400,526 | A | 3/1995 | Sessa | |
| 5,596,820 | A | 1/1997 | Edauw | |
| 5,738,937 | A | 4/1998 | Baychar | |
| 5,746,013 | A * | 5/1998 | Fay, Sr. | 36/3 R |
| 5,797,610 | A | 8/1998 | Grande | |
| 5,878,513 | A | 3/1999 | Annovi | |
| 5,955,172 | A | 9/1999 | Huerten | |
| 6,041,518 | A * | 3/2000 | Polycarpe | 36/2.6 |
| 6,196,556 | B1 | 3/2001 | Bonaventura | |
| 6,233,845 | B1 | 5/2001 | Belli | |
| 6,280,815 | B1 * | 8/2001 | Ersfeld et al. | 428/71 |
| 6,401,364 | B1 | 6/2002 | Burt | |
| 6,408,540 | B1 * | 6/2002 | DeKalb et al. | 36/8.1 |
| 6,732,455 | B2 | 5/2004 | Bordin | |
| 6,766,539 | B1 | 7/2004 | Huber | |
| 6,826,853 | B1 | 12/2004 | Zanatta | |
| 6,874,252 | B2 | 4/2005 | Nakano | |
| 6,993,858 | B2 | 2/2006 | Seamans | |
| 7,024,803 | B2 * | 4/2006 | Basso | 36/3 B |
| D520,219 | S | 5/2006 | Mazzarolo | |
| D547,032 | S | 7/2007 | Mazzarolo | |
| 7,251,907 | B1 | 8/2007 | Bondarchuk | |
| 7,337,557 | B2 * | 3/2008 | Miyata | 36/3 B |
| 7,363,765 | B2 | 4/2008 | Szczesuil | |
| 7,437,838 | B2 | 10/2008 | Nau | |
| 7,441,351 | B2 | 10/2008 | Clark | |
| 7,543,398 | B2 | 6/2009 | Hsiao | |
| 7,546,697 | B2 | 6/2009 | Polegato | |
| 7,549,238 | B2 | 6/2009 | Patakos | |
| 7,610,694 | B2 | 11/2009 | De Giacomi | |
| 7,673,399 | B2 | 3/2010 | Garcia-Perez | |
| 7,913,421 | B2 | 3/2011 | Malenotti | |
| 7,958,655 | B2 | 6/2011 | Munns | |
| 8,074,375 | B2 | 12/2011 | Longuet | |
| 8,127,465 | B2 | 3/2012 | Byrne | |
| 8,146,266 | B2 | 4/2012 | Vattes | |
| 8,151,484 | B2 | 4/2012 | Hubner | |
| 2005/0120591 | A1 | 6/2005 | Andrew | |
| 2007/0074424 | A1 * | 4/2007 | Lin | 36/44 |
| 2009/0107013 | A1 | 4/2009 | Berger | |
| 2009/0293318 | A1 | 12/2009 | Plourde et al. | |
| 2010/0071234 | A1 | 3/2010 | Basso | |

FOREIGN PATENT DOCUMENTS

| | | | |
|---|---|---|---|
| FR | 861788 | A | 2/1941 |
| FR | 2424716 | | 11/1979 |
| FR | 2821758 | A | 9/2002 |
| WO | 9835572 | A | 8/1998 |

OTHER PUBLICATIONS

"PCT International Preliminary Report on Patentability dated Jun. 10, 2010 for PCT/IB2009/053576, from which the instant application is based," 6 pgs.

PCT International Search Report dated Oct. 20, 2009 for PCT/EP2009/059594, 3 pages.

U.S. Appl. No. 13/055,033 Office Action mailed Jan. 4, 2013, 11 pages.

U.S. Appl. No. 13/055,033 Final Office Action mailed May 24, 2013, 12 pages.

U.S. Appl. No. 13/055,033 Amendment filed Nov. 22, 2013, 10 pages.

U.S. Appl. No. 13/055,033 Amendment filed Apr. 24, 2013, 15 pages.

U.S. Appl. No. 13/055,033, Final Office Action mailed Aug. 29, 2014, 10 pages.

U.S. Appl. No. 13/055,033 Amendment filed Aug. 12, 2014, 10 pages.

U.S. Appl. No. 13/055,033 Non-Final Office Action mailed Mar. 14, 2014, 10 pages.

Statement of Substance of Interview for U.S. Appl. No. 13/055,033, submitted Aug. 12, 2014, 1 page.

Applicant Initiated Interview Summary for U.S. Appl. 13/055,033, mailed Jul. 10, 2014, 3 pages.

U.S. Appl. No. 13/055,033, Amendment filed Nov. 26, 2014, 9 pages.

U.S. Appl. No. 13/055,033, Notice of Allowance dated Mar. 2, 2015, 7 pages.

* cited by examiner 50
10
56
14
42
12

24
10
34
36
12

24
56
10
14
16
22

22
14
22
16
19

22
22
15
14

30
22
26
14
22
10
24
16
32
28

27
28
22
14
26
27
22

MOTORCYCLE BOOT WITH VENTILATED STRUCTURE

RELATED APPLICATIONS

This application is a 35 U.S.C. 371 national stage filing from International Application No. PCT/IB2009/053576 filed Aug. 13, 2009 and claims priority to Italian Application No. TV2008A000108 filed Aug. 13, 2008, the teachings of which are incorporated herein by reference.

FIELD(S) OF THE INVENTION

The present invention relates to a footwear article for sporting use, in particular a motorcycle boot.

The following description will refer specifically to motorcycle boots, it being understood that this is not intended to limit the scope of possible applications of the invention.

BACKGROUND

It is known that one of the problems associated with the use of boots, in particular during motorcycle races, is that of overheating of the foot enclosed inside the boot, this representing a major problem for the user.

More generally, the problem of the foot ventilation has been the subject of numerous studies and many solutions are known where holes are provided mainly in the tread of the boot, with special systems for preventing the entry of water in the event of rain.

Other solutions are known, for example in the case of boots for in-line skates, where the boot upper is provided with ventilation openings which are protected by air-permeable material (for example in the form of a fine mesh) so that, during use of the boot, the air which enters through these ventilation openings or windows strikes the front part of the foot.

BRIEF SUMMARY OF EMBODIMENTS OF THE INVENTION

However, in the specific case of motorcycle boots, it is required to provide a substantial flow of cooling air and ensure that this flow passes over the entire bottom surface of the foot, without being limited to the front portion.

This result has not yet been achieved with the solutions proposed by the prior art and therefore constitutes the main technical problem and the object of the present invention.

This object is achieved with a footwear article, in particular a motorcycle boot of the type comprising an upper and an outsole or tread, which are joined together along the bottom edge of the upper, as well as a insole which rests on the outsole, the footwear article being characterized in that it comprises:

(a) an interspace formed at least in the front part of the boot between the inner surface of the outsole and the bottom surface of the insole, said insole being provided with at least one through-hole and preferably with a plurality of through-holes distributed in a predetermined manner opposite said interspace, (b) a footbed intended to rest on the upper surface of said insole and comprising a plurality of air distribution channels designed to convey the air into all the desired zones of the sole of the foot when it rests on said footbed, said channels communicating with said at least one or said plurality of through-holes formed in said insole;

(c) at least one air inlet opening or air intake, formed in the zone where said upper and said outsole are joined together opposite said interspace, so as to freely connect the exterior of the boot with said interspace.

In the preferred embodiment of the invention said plurality of air distribution channels is formed by means of a material consisting of a double layer of fabric made with yarn which is sufficiently rigid to define between the two layers parallel tubular channels, said tubular channels communicating freely with the exterior.

An example of this material, made with polyester yarn, is that commercially available under the trade name "Air Spring".

In this preferred embodiment of the boot according to the present invention a layer of material for conveying and distributing the air is also present in said interspace in the form of an additional insole, so as to favour the distribution of the air entering via said air intake.

In the same preferred embodiment said air intake is formed on a portion of the front part of the boot which is offset from the toe and preferably offset towards the inner side of the boot so that the motorcycle structure is able to protect it against the entry of particles of dust and/or liquids, in particular rain.

If necessary, for example in the event of rain, said air intake arrangement allows the rider to rest the part of the boot where the air intake is formed against the body of the motorcycle so as to prevent the entry of water and/or foreign bodies.

Alternatively it is possible to provide the boot with a cover, for example removably fixed to the upper, so as to provide the possibility of closing off the air intake if necessary, for example in the event of rain.

In the above description reference has been made to a single air intake, but it is understood that there may be several air intakes so as to favour a greater incoming flow of cooling air.

BRIEF DESCRIPTIONS OF DRAWINGS

The features and advantages of the present invention will emerge more clearly from the description which follows of a preferred embodiment, provided with reference to the accompanying drawings in which.

Figure 3A:
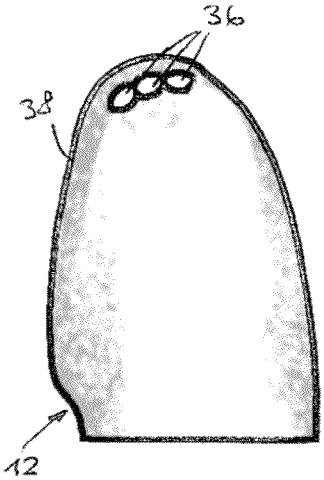
FIG. 3 is a substantially front view, on a larger scale, of the boot outsole or tread.
Figure 3:
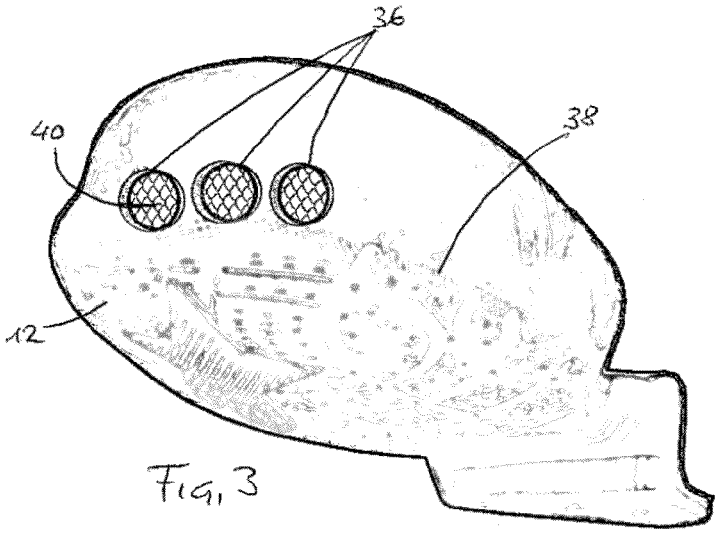
Figure 3B:
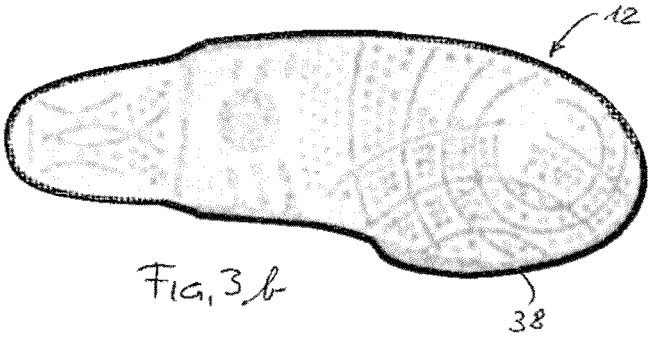
Figure 4:
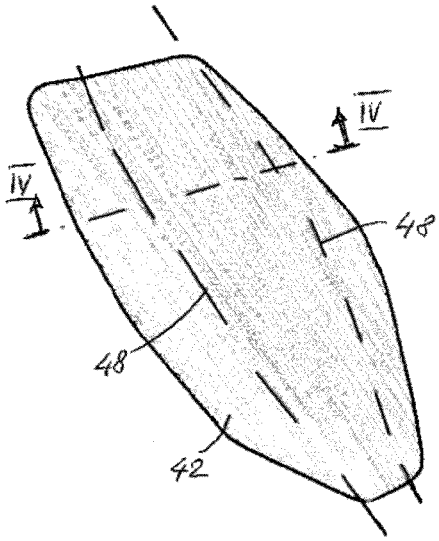
Figure 4A:
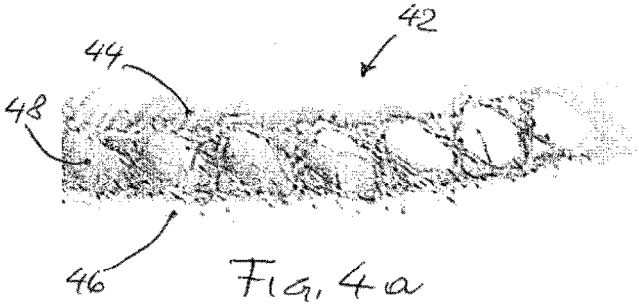
Figures 5, 5A, 5B, 5C, 5D:
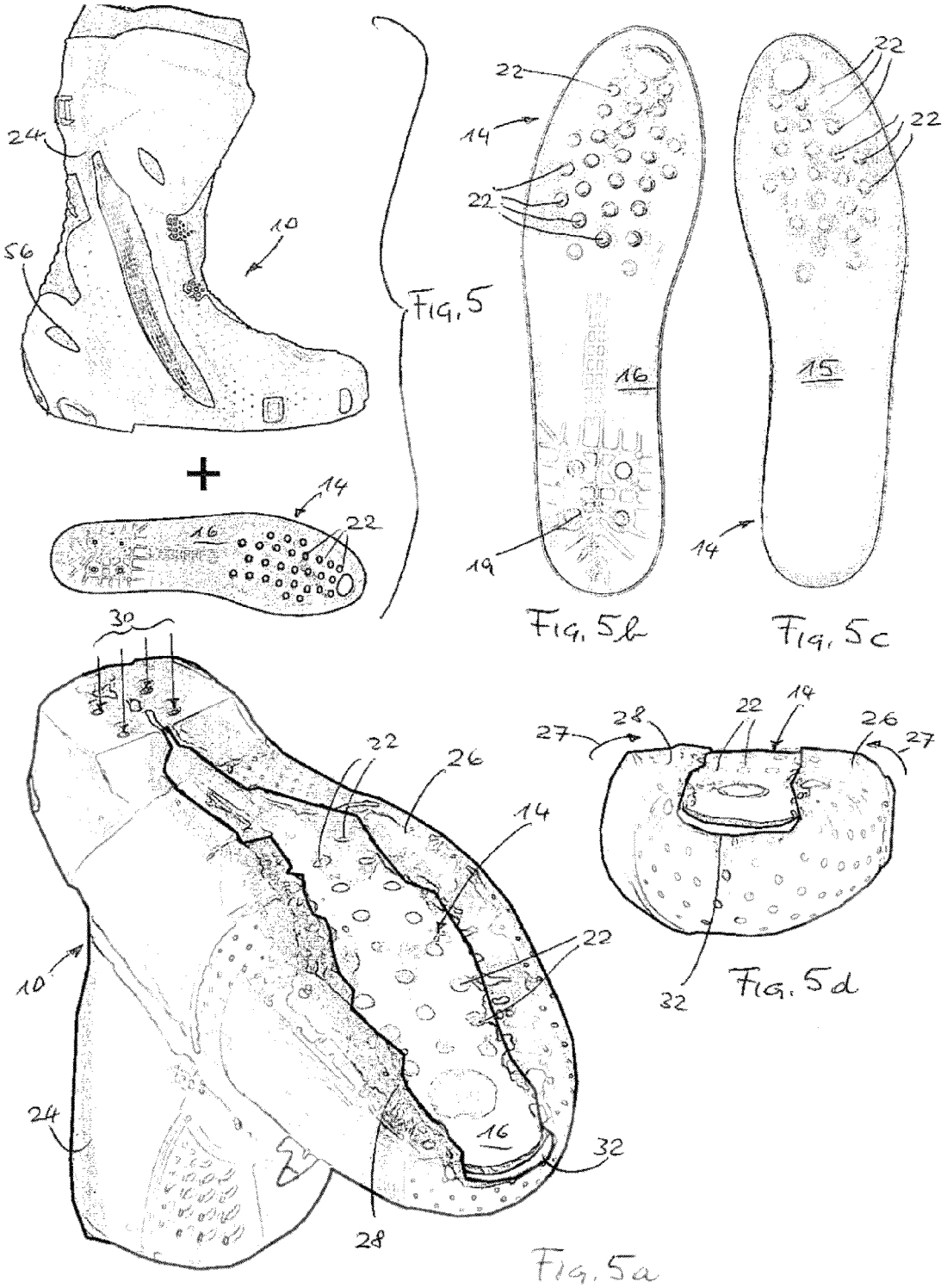
Figure 6A:
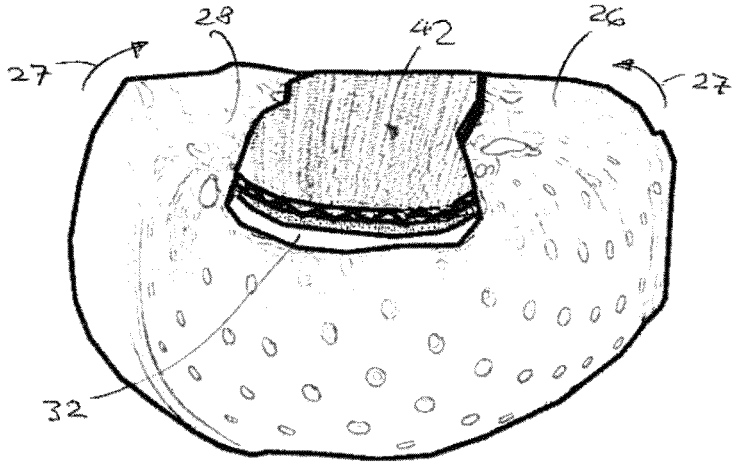
Figure 6:
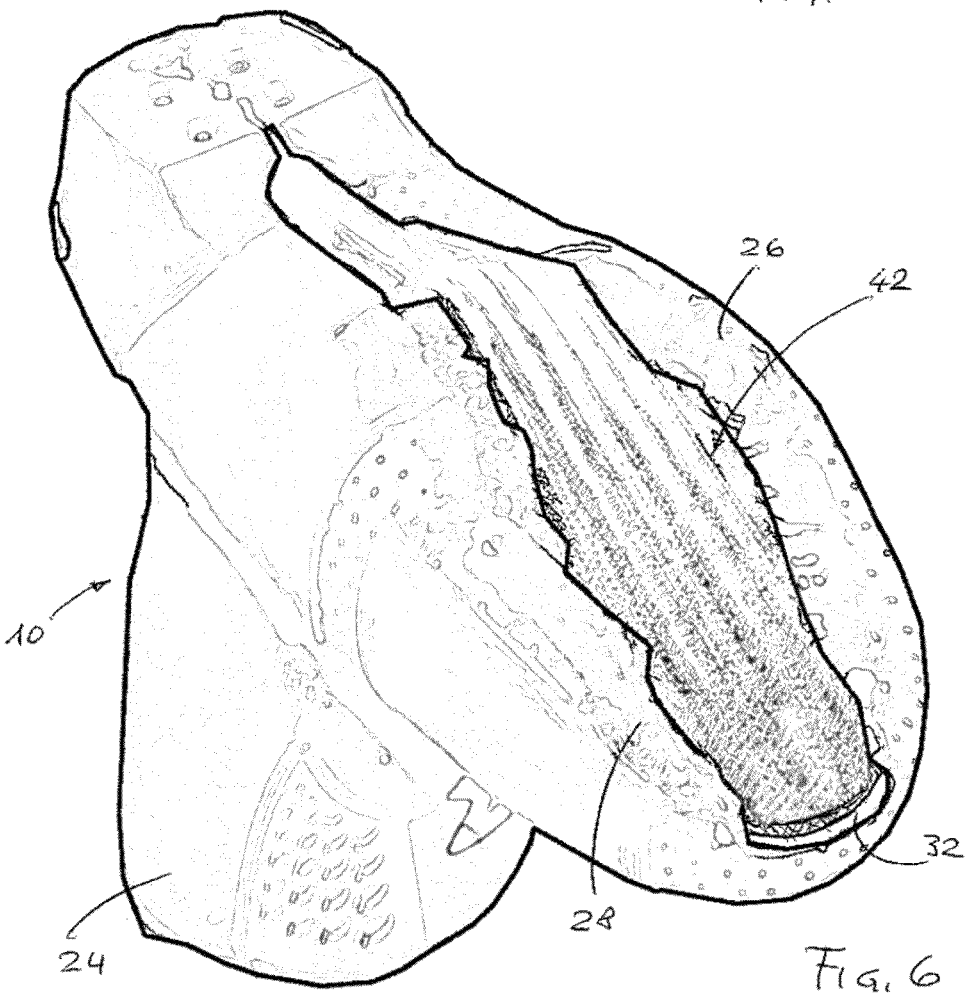

FIG. 3*a* is a partial plan view, from above, of the outsole according to FIG. 3;

FIG. 3*b* is a plan view, from below, of the outsole according to FIG. 3;

FIGS. 4 and 4*a* are a plan view and a cross-sectional view, respectively, (along the line IV-IV of FIG. 4) of the additional insole for distributing ventilation air;

FIG. 5 is an exploded view of the upper formed in the manner of a boot and the insole which closes the bottom of the upper;

FIG. 5*a* is an axonometric view of the upper shown in an overturned position;

FIGS. 5*b* and 5*c* are plan views, from below and from above, respectively, of said insole;

FIG. 5*d* is a partial front view of the upper with said insole mounted;

FIG. 6 is an axonometric view of the upper during a successive stage of assembly of the boot, i.e. after mounting of the additional insole for distributing the ventilation air, shown in FIGS. 4 and 4*a;*

Figure 7:
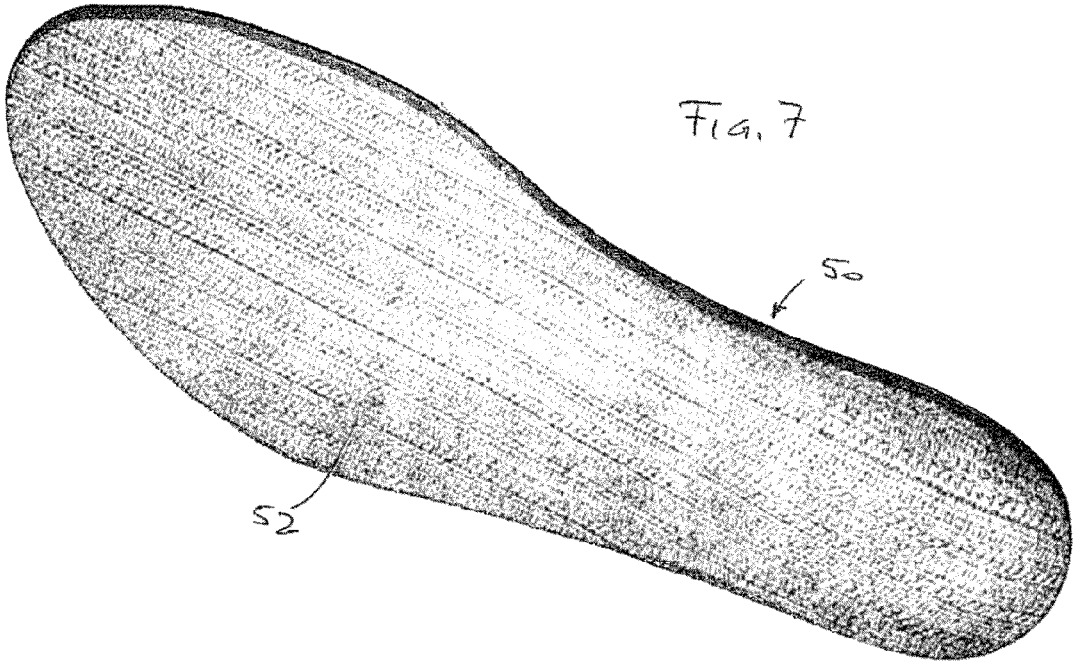
Figure 8:
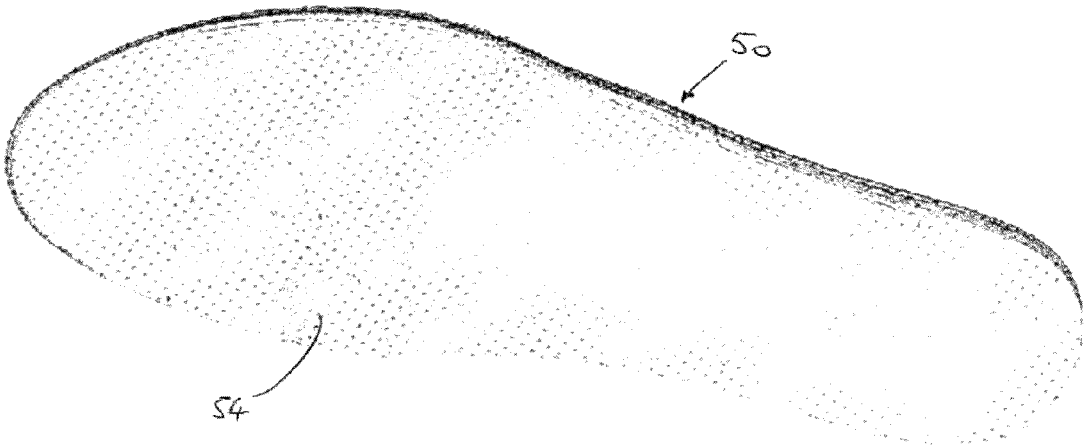

FIG. 6*a* is a view corresponding to FIG. 5*d* of the upper during the stage for assembly of said additional insole, and FIGS. 7 and 8 are plan views, from below and from above, respectively, of the footbed inside the boot.

DETAILED DESCRIPTION OF EMBODIMENTS OF THE INVENTION

Figure 2:
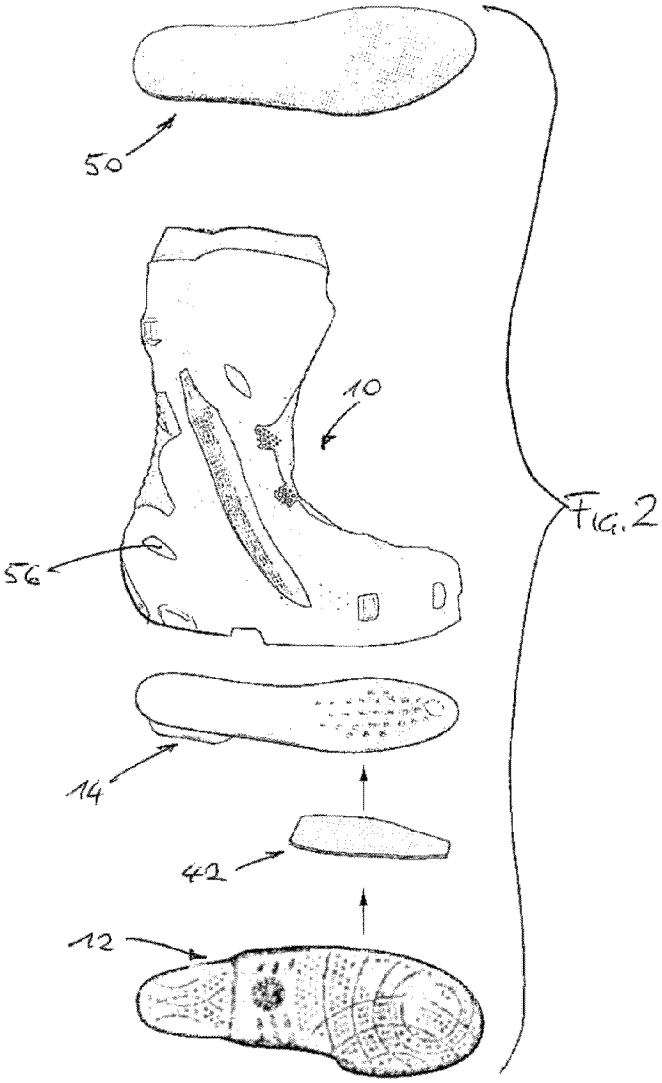
FIG. 2 is an exploded view of the various components of the boot according to FIG. 1, before assembly.
Figure 1:
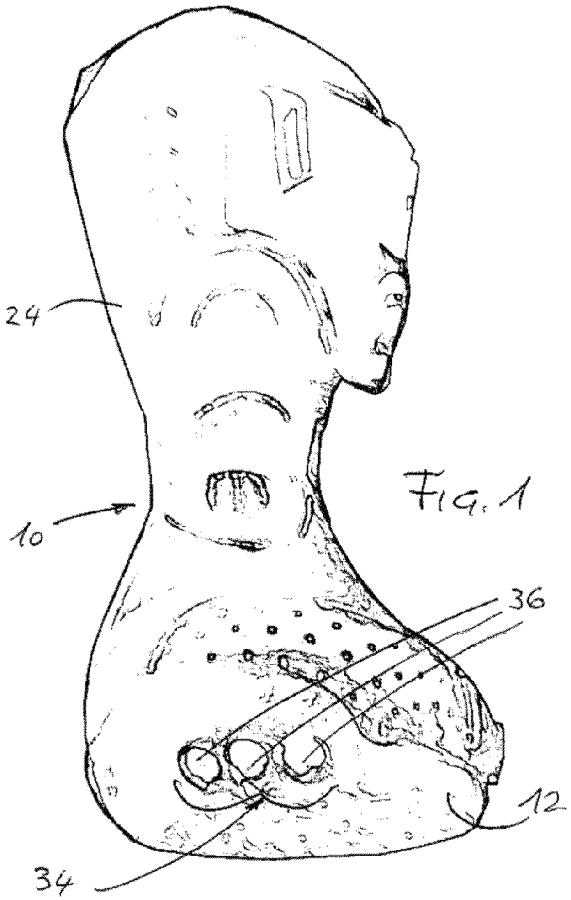
FIG. 1 is a front view of the boot according to the present invention.

With reference firstly to FIGS. 1 and 2, the boot according to present invention comprises an upper 10 which is joined along its bottom edge in a manner known per se to the contour of an outer sole or tread 12 which from hereon will be referred to simply as "outsole".

The boot is provided internally with an insole 14 which has a conventional structure and the bottom surface 16 of which rests on the upper or inner surface 20 of the outsole 12, in some cases by means of support elements 19 which are known per se—see FIG. 5*b*.

As clearly shown in FIGS. 5*b* and 5*c*, a plurality of holes 22 are distributed in an orderly manner over the entire front surface of the insole 14.

FIGS. 5*a* and 5*d* clearly show how the insole 14 is fixed to the upper 10.

From FIG. 5*a* it can be seen that the upper 10 comprises a portion 24 shaped in the manner of a leg piece and a bottom part 26 consisting of two flaps 26 and 28 which are spaced from each other so as to leave an open area inside which the insole 14 is inserted with its bottom surface 16 directed towards the outside of the boot.

From FIG. 5*d* it can be readily seen how fixing of the insole 14 to the upper 10 is performed by folding over the bottom flaps 26 and 28 on top of the perimetral edges of the insole 14 (as indicated by the arrows 27) and completing fixing in the region of the boot heel for example by means of screws, indicated by the arrows 30 in FIG. 5*a*.

From FIGS. 5*a* and 5*d* it can also be seen how at the front end of the boot the toe portion of the upper 10 is cut in the form of a U so as to leave the front edge uncovered. This thus forms a slit which is indicated by the reference number 32 and the purpose of which will be clarified below.

With the upper in the condition shown in FIG. 5*a*, i.e. with the insole 14 mounted and glued in position, an additional insole 42 (shown in FIG. 4) is then mounted, said insole being glued to the upper 10 so as to be arranged over the insole 14 forming the structure shown in FIG. 6.

In particular, the front end of the additional insole 42 is aligned at the front and coincides with the front end of the insole 14 so that the front slit 32 remains open.

As already mentioned, the additional insole 42 has a plurality of tubular channels directed substantially parallel to the main axis of the boot (namely the toe-heel axis) and is made of air-permeable material.

A material of this kind is that commercially known by the name of Air Spring and is formed by two layers 44 and 46 of semirigid polyester yarn which are woven so as form the walls of a plurality of tubular channels or passages 48 which extend along the main axis of the boot—see FIG. 4*a*. Particularly, in looking to FIG. 4*a* (showing cross-sectional view of the Air Spring material with reference to FIG. 4), the channels 48 are shown directly adjacent each other in side to side manner, such that, and with further reference to FIG. 4 (showing plan view of the Air Spring material), the channels 48 are parallel and extend longitudinally along the insole 42.

Accordingly to a preferred embodiment of the invention, said tubular channels (48) are from 5 to 50, preferably from 10 to 45, more preferably from 15 to 40, depending on the size of the boot.

The two layers 44 and 46 are made of spun material, i.e. of a textile nature, and are therefore air-permeable. The air, flowing along each of the tubular passages 48, filters through their walls 44 and 46 and via the holes 22 (provided in the midsole 14) passes inside the cavity of the upper 10 inside which the user's foot is seated. Inside this cavity, above the upper surface 15 of the insole 14, a footbed 50, formed preferably by two layers of material (see FIGS. 7 and 8), is positioned.

The bottom layer of the footbed 50, the surface 52 of which rests directly on the upper surface 15 of the insole 14, consists of the same material (Air Spring) from which the additional insole 42 is made. As such, and with reference back to FIG. 4*a*, the surface 52 is formed by two layers 44 and 46 of semirigid polyester yarn woven to form a plurality of tubular channels 48 directly adjacent each other in side to side manner, such that, and with further reference to FIG. 7, the channels 48 are parallel and extend longitudinally along the footbed 50, with a majority of the channels 48 extending between front and rear ends of the footbed, and correspondingly, the upper 10. The (optional) upper surface of the same footbed 50, on the upper layer 54 of which the user's foot rests, is made of a normal breathable material used for the insoles of shoes.

From the above description it can be understood how, in the front portion of the boot, preferably in the region of the forefoot, between upper 10 and outsole or tread 12, an interspace is formed between the inner or upper surface 20 of the outsole 12 and the bottom surface of the insole 14. This interspace is in practice occupied by the additional insole 42.

From FIG. 3 it can also be seen how the outsole or tread 12 has at the front a raised perimetral edge 38 which, as already mentioned, forms the zone where the outsole 12 is joined to the bottom flap of the upper 10.

Considering the way in which the insole 14 is fixed to the upper 10, it is clear that, when the upper is fixed to the outsole or tread, the aforementioned interspace is created at the front between the insole and the inner surface of the outsole, while the rear or heel part of the insole rests directly against the upper surface of the outsole or tread.

This interspace communicates with the exterior via an airtake, indicated generically by the reference number 34 and formed in the aforementioned zone where the upper 10 and the outsole 12 are joined together. This air intake extends following the outer profile of the outsole and therefore the zone where it is joined to the upper.

In the embodiment shown the air intake 34 is formed by three aligned holes 36 which are formed in the raised front edge 38 of the outsole 12. A protection mesh 40 is fixed by means of gluing onto said holes, within the edge 38.

The air intake 34 is thus situated opposite the slit 32 so that the incoming air is channelled through the air intake and distributed over all the front ends of the tubular channels 48.

As already mentioned, the complete air-permeability of the layers 44 and 46 which form the tubular channel walls 48 ensures that the air flow channelled into each of them, when intersecting one of the through-holes 22 of the insole, is partly deviated through the aforementioned through-hole and transferred to the zone situated above said insole.

As already mentioned, the footbed 50 is arranged above the insole 14, so that the air passing through the holes 22 penetrates through the surface 52 of the bottom layer of the footbed 50 inside the tubular channels or holes formed in said bottom layer and from here, via the upper breathable layer of the said footbed, is distributed over the entire surface of the user's foot.

Accordingly to a preferred embodiment of the present invention, said through holes (22) are from 5 to 50, preferably from 10 to 45, more preferably from 15 to 40, depending on the size of the boot.

In order to increase the air flow which passes over the user's foot it is possible and envisaged to provide in the rear zone of the upper 10 vent openings 56 (see FIGS. 2 and 5) which are formed above the plane of the footbed 50 so that a natural draft is created between the front air intake 34 and the rear openings 56.

It is clear that ventilation and cooling are dependent on the fact of using the boot on fast-moving transportation means, in particular a motorcycle.

As can be understood from the figures, the air intake 34 is positioned on the raised front edge 38 in a position offset with respect to the toe of the shoe and preferably towards the inner part of the boot. In this way:

(i) during normal use the air intake is partly screened to prevent the entry of foreign bodies;

(ii) in the event of rain or in wet or muddy conditions, the user merely rests the inner part of the boot and hence the air intake against the motorcycle body, closing the opening and preventing the entry of air or foreign bodies;

(iii) in the event of persistent rain it is possible to use a cover, which may be fixed to the boot, so as to close the air intake in a removable manner.

It is also possible and envisaged using more than one air intake, distributing them along the surface of the aforementioned contact zone, so as to increase the incoming air flow and improve the distribution of the air inside the interspace.

As an alternative to the material previously indicated for the manufacture of the additional insole 42, it is possible to envisage a layer of material which has a plurality of channels formed in the thickness of the material and oriented in relation to the portions of the insole to which the ventilation and cooling air flow is to be conveyed.

Alternatively, it also possible to envisage shaping the air intake 34 so that it may be connected, in a manner such that it can be easily released, to a source of hot air, for example produced by the engine of the motorcycle, so as to obtain heating of the footbed 50.

The invention claimed is:

1. A motorcycle boot having an upper and an outsole joined together along a bottom edge of the upper, as well as an insole which rests on the outsole, comprising:

(a) an interspace formed at least in a front part of the boot between an inner surface of the outsole and a bottom surface of the insole, said insole being provided with at least one through-hole;

(b) an air-permeable footbed resting on an upper surface of said insole and comprising a plurality of air distribution tubular channels configured to convey air flowing at a front end of the upper into a sole of a foot of a user when resting on said footbed, said channels communicating with the at least one through-hole and being formed of a material consisting of a double layer of fabric which is sufficiently rigid so as to define said channels between layers of said double layer, said tubular channels being parallel and communicating freely with the exterior, said tubular channels extending longitudinally along the footbed;

(c) an additional insole being present in said interspace between said inner surface of the outsole and bottom surface of the insole, said additional insole comprising a plurality of air distribution tubular channels extending longitudinally along the additional insole and formed of the material consisting of a double layer of fabric;

(d) at least one air intake defining one or more holes at the front end of the upper and formed in a zone where said upper and said outsole are joined together opposite said interspace, so as to freely connect exterior of the boot with said interspace; and (e) a vent opening positioned at a rear zone of the upper so as to create a natural draft between the at least one air intake and the vent opening.

2. The motorcycle boot of claim 1, wherein said at least one air intake is formed on a portion of the front part of the boot which is offset from a toe portion.

3. The motorcycle boot of claim 1, wherein said upper comprises two bottom flaps which are spaced from each other so as to leave an open area where both said insole and said additional insole are fixed, wherein said insole is directed towards an internal cavity which houses a user's foot.

4. The motorcycle boot of claim 3, wherein said insole and said additional insole are fixed to the bottom edge of said upper by folding over said bottom flaps on top of edges of said insoles.

5. The motorcycle boot of claim 3, wherein said upper has, at the front part of the boot, a toe portion cut in the form of a U so as to form a slit aligned with said at least one air intake.

6. The motorcycle boot of claim 1, wherein said footbed, which is positioned inside the upper and designed to come into contact with the user's foot, comprises a bottom layer of air-permeable material comprising the plurality of air distribution tubular channels.

7. The motorcycle boot of claim 6, wherein said footbed comprises an upper layer of breathable material.

8. The motorcycle boot of claim 1, wherein at least one air vent opening is formed in the rear zone of said upper, the at least one air vent opening being positioned at a level higher than a plane of said footbed.

9. The motorcycle boot of claim 1, wherein the insole is provided with a plurality of through holes.

10. The motorcycle boot of claim 9, wherein said through holes are of a quantity from 5 to 50.

11. The motorcycle boot of claim 10, wherein said through holes are of a quantity from 10 to 45.

12. The motorcycle boot of claim 11, wherein said through holes are of a quantity from 15 to 40.

13. The motorcycle boot of claim 1, wherein the additional insole comprises a plurality of air distribution tubular channels of a quantity from 5 to 50.

14. The motorcycle boot of claim 13, wherein the plurality of air distribution tubular channels of the additional insole are of a quantity from 15 to 40.

15. The motorcycle boot of claim 2, wherein said at least one air intake is formed on a portion of the front part of the boot which is offset towards an inner side of the boot so structure of the boot is protected against entry of particles of one or more of dust and liquid.

16. The motorcycle boot of claim 1, wherein the fabric comprises yarn.

17. The motorcycle boot of claim 1, wherein the upper has a portion configured to wrap around a user's leg.

18. The motorcycle boot of claim 1, wherein neighboring ones of the tubular channels being directly adjacent each other in side to side manner.

19. A motorcycle boot having an upper and an outsole joined together along a bottom edge of the upper, as well as an insole which rests on the outsole, comprising:

(a) an interspace formed at least in a front part of the boot between an inner surface of the outsole and a bottom surface of the insole, said insole being provided with at least one through-hole;

(b) an air-permeable footbed resting on an upper surface of said insole and comprising a plurality of air distribution tubular channels configured to convey air into a sole of a foot of a user when resting on said footbed, said channels communicating with the at least one through-hole and being formed of a material consisting of a double layer of fabric which is sufficiently rigid so as to define said channels between layers of said double layer, said tubular channels being parallel and communicating freely with the exterior, said tubular channels extending longitudinally along the footbed, a majority of the tubular channels extending between front and rear ends of the upper;

(c) an additional insole being present in said interspace between said inner surface of the outsole and bottom surface of the insole, said additional insole comprising a plurality of air distribution tubular channels extending longitudinally along the additional insole and formed of the material consisting of a double layer of fabric;

(d) at least one air intake formed in a zone where said upper and said outsole are joined together opposite said interspace, so as to freely connect exterior of the boot with said interspace; and (e) a vent opening positioned at a rear zone of the upper so as to create a natural draft between the at least one air intake and the vent opening via the tubular channels.

* * * * *